US009945533B1

(12) United States Patent
Orbe

(10) Patent No.: US 9,945,533 B1
(45) Date of Patent: Apr. 17, 2018

(54) UNIFORM LENS ILLUMINATION IN DOWNLIGHT FIXTURES

(71) Applicant: Orestes Orbe, Atlanta, GA (US)

(72) Inventor: Orestes Orbe, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 132 days.

(21) Appl. No.: 15/170,176

(22) Filed: Jun. 1, 2016

(51) Int. Cl.

| | |
|---|---|
| ***F21V 1/00*** | (2006.01) |
| ***F21V 3/00*** | (2015.01) |
| ***F21V 7/00*** | (2006.01) |
| ***F21V 13/10*** | (2006.01) |
| ***F21V 19/00*** | (2006.01) |
| ***F21S 8/02*** | (2006.01) |
| *F21Y 101/02* | (2006.01) |

(52) U.S. Cl.
CPC ..... *F21V 3/00* (2013.01); *F21S 8/026* (2013.01); *F21V 7/00* (2013.01); *F21V 13/10* (2013.01); *F21V 19/003* (2013.01); *F21Y 2101/02* (2013.01)

(58) Field of Classification Search
CPC ..... F21V 3/00; F21V 3/0427; F21V 3/0445; F21V 13/10; F21V 7/00; F21V 19/003; F21Y 2101/02
See application file for complete search history.

(56) References Cited

U.S. PATENT DOCUMENTS

| | | | | |
|---|---|---|---|---|
| 6,565,234 | B1 * | 5/2003 | Skegin | F21S 8/00 362/127 |
| 9,010,956 | B1 * | 4/2015 | Davis | F21V 17/06 362/147 |
| 9,739,455 | B2 * | 8/2017 | Rodriguez | F21V 15/01 |
| 2009/0021931 | A1 * | 1/2009 | Mayer | F21V 7/04 362/235 |
| 2015/0138779 | A1 * | 5/2015 | Livesay | F21S 8/026 362/298 |

* cited by examiner

*Primary Examiner* — Ali Alavi
(74) *Attorney, Agent, or Firm* — King & Spalding LLP

(57) ABSTRACT

A downlight fixture includes a housing reflector member having a top edge that defines a first aperture, a bottom edge that defines a second aperture, and a body that extends from the top edge to the bottom edge. Further, the downlight fixture includes a top reflector panel coupled to the housing reflector member such that it covers the first aperture. Furthermore, the downlight fixture includes a lens that is coupled to the housing reflector member such that it covers the second aperture. An inner surface of the body and a surface of the top reflector member facing the lens are reflective. Additionally, the downlight fixture includes a plurality of light sources disposed on the top reflector member adjacent a perimeter of the top reflector panel such that the plurality of light sources are outside a perimeter of the lens and facing the inner surface of the housing reflector member's body.

20 Claims, 12 Drawing Sheets

UNIFORM LENS ILLUMINATION IN DOWNLIGHT FIXTURES

TECHNICAL FIELD

The present disclosure relates generally to lighting fixtures, and in particular to a uniform lens illumination in downlight fixtures.

BACKGROUND

Conventional downlight fixtures with backlit illumination may create visual hot spots of light on a lens that covers the light sources, resulting in a non-uniform brightness or an undesirable glare across the lens. For example, when a person looks up at the light fixture that uses light emitting diode (LED) light sources, they may see point sources created by the light being emitted by each of the LEDs. This problem is generated by the significant contrast in the amount of light being generated by the LED when compared to the immediate area around the LED, which is not emitting any light. The high contrast between the portions of the fixture emitting light (the LEDs and lens) and the non-light emitting portions can generate unpleasant glare. Existing solutions to reduce the contrast between the light being emitted by the light sources and the remaining portion of the light fixture facing the environment to be illuminated may include increasing a thickness of the downlight fixtures to provide a larger distance between the light sources and the lens. Alternatively, a very thick diffusing lens may be used. However, both the existing solutions mentioned above may diminish light output efficiency of the downlight fixtures. Further, a downlight fixture that incorporates the above-mentioned solutions may have a thick profile which may undesirable in terms of the aesthetics of the downlight fixture. Thus, there remains a need for a back lit downlight fixture that can provide a substantially uniform illumination of the lens while maintaining a thin profile.

SUMMARY

In one aspect, the present disclosure can relate to a downlight fixture. The downlight fixture includes a mounting plate configured to mount the downlight fixture to a mounting surface. Further, the downlight fixture includes a housing reflector member coupled to and disposed below the mounting plate. The housing reflector member includes a top edge that defines a first aperture, a bottom edge that defines a second aperture disposed below and opposite the first aperture, and a reflector body extending between the top edge and the bottom edge and having an inner surface and an outer surface that is opposite to the inner surface. Furthermore, the downlight fixture includes a top reflector panel coupled to the housing reflector member such that at least a portion of the top reflector panel covers the first aperture. A lens is coupled to the housing reflector member such that at least a portion of the lens covers the second aperture. Additionally, the downlight fixture includes a plurality of light sources disposed on a surface of the top reflector panel facing the lens and adjacent a perimeter of the top reflector panel such that the plurality of light sources are: (a) outside a perimeter of the lens, and (b) above the reflector body of the housing reflector member.

In another aspect, the present disclosure can relate to a downlight fixture. The downlight fixture includes a housing reflector member. The housing reflector member includes a curved portion having a substantially concave inner profile and extending from a top edge of the housing reflector member to an intermediate edge of the housing reflector member. Further, the housing reflector member includes a stairway shaped portion disposed below the curved portion and extending substantially laterally inwards from the intermediate edge of the housing reflector member to a bottom edge of the housing reflector member. A top reflector panel is coupled to the curved portion of the housing reflector member such that at least a portion of a perimeter of the top reflector panel is disposed on the top edge of the housing reflector member. Further, a lens is coupled to the stairway shaped portion of the housing reflector member adjacent the bottom edge of the housing reflector member. Furthermore, the downlight fixture includes a plurality of light emitting diodes (LEDs) disposed on a surface of the top reflector panel facing the lens and adjacent the perimeter of the top reflector panel such that the plurality of LEDs are positioned: (a) outside a perimeter of the lens, and (b) above the curved portion of the housing reflector member.

In yet another aspect, the present disclosure can relate to a downlight fixture. The downlight fixture includes a mounting plate configured to mount the downlight fixture to a mounting surface. Further, the downlight fixture includes a housing reflector member coupled to and disposed below the mounting plate. The housing reflector member includes a top edge, a bottom edge that defines an aperture, and a reflector body extending between the top edge and the bottom edge and having a reflective inner surface and an outer surface that is opposite to the reflective inner surface. Further, the downlight fixture includes a top reflector panel coupled to the top edge of the housing reflector member, and a lens coupled to the housing reflector member such that at least a portion of the lens covers the aperture. Furthermore, the downlight fixture includes a plurality of light sources disposed on the housing reflector member adjacent the bottom edge of the housing reflector member such that the plurality of light sources are outside a perimeter of the lens.

These and other aspects, objects, features, and embodiments will be apparent from the following description and the appended claims.

BRIEF DESCRIPTION OF THE DRAWINGS

The foregoing and other features and aspects of the disclosure are best understood with reference to the following description of certain example embodiments, when read in conjunction with the accompanying drawings, wherein.

Figure 1A:
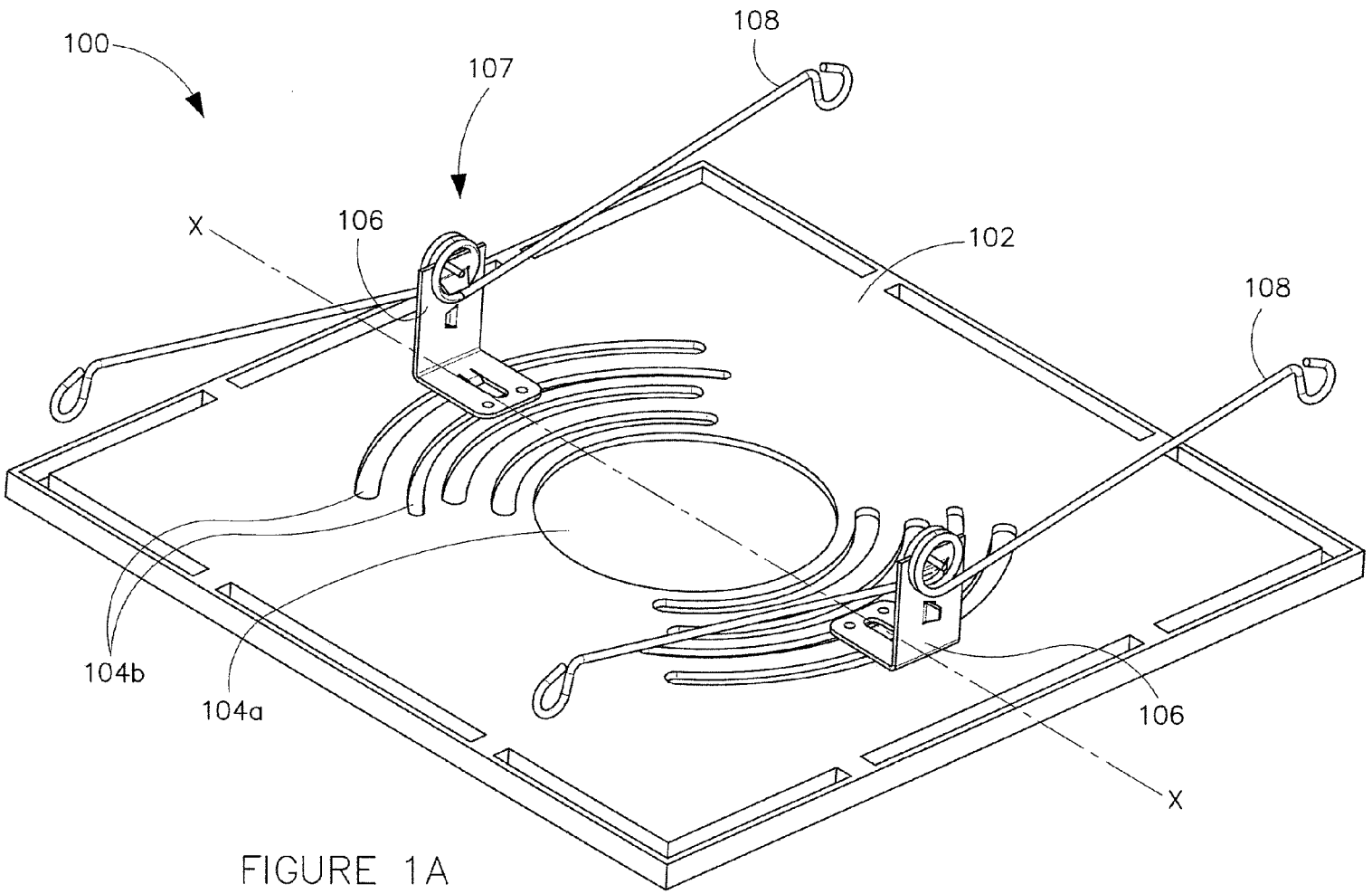
FIG. 1A illustrates a perspective view of a uniform lens illumination downlight fixture, in accordance with an example embodiment of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

BRIEF DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to an example uniform lens illumination downlight fixture (herein downlight fixture') that includes at least a plurality of light sources and a lens that covers the plurality of light sources. In particular, the plurality of light sources are disposed at a distance above the lens and positioned outside a perimeter of the lens to reduce an amount of direct light exiting the downlight fixture through the lens. Further, the plurality of light sources are positioned such that an inner profile of the downlight fixture's housing receives the light emitted by the plurality of light sources and/or operates in concert with a reflector panel of the downlight fixture to reflect the light towards the lens and/or a space (e.g., luminous cavity) between the reflector panel and the lens (above the lens), thereby increasing a reflected or indirect light exiting the downlight fixture through the lens. Stated another way, the plurality of light sources have a vertical position that is directly above the inner profile of the downlight fixture's housing to minimize the visibility of point sources of light when looking up at the fixture. That is, the example downlight fixture of the present disclosure provides a more uniform illumination of the lens by reducing the amount of direct light exiting the downlight fixture and increasing an amount of indirect or reflected light exiting the downlight fixture. Additionally, the above-mentioned arrangement of the lens and the plurality of light sources allows the example downlight fixture of the present disclosure to have a thin profile, i.e., reduce a distance between a surface on which the plurality of the light sources are disposed and the lens.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

Figure 1B:
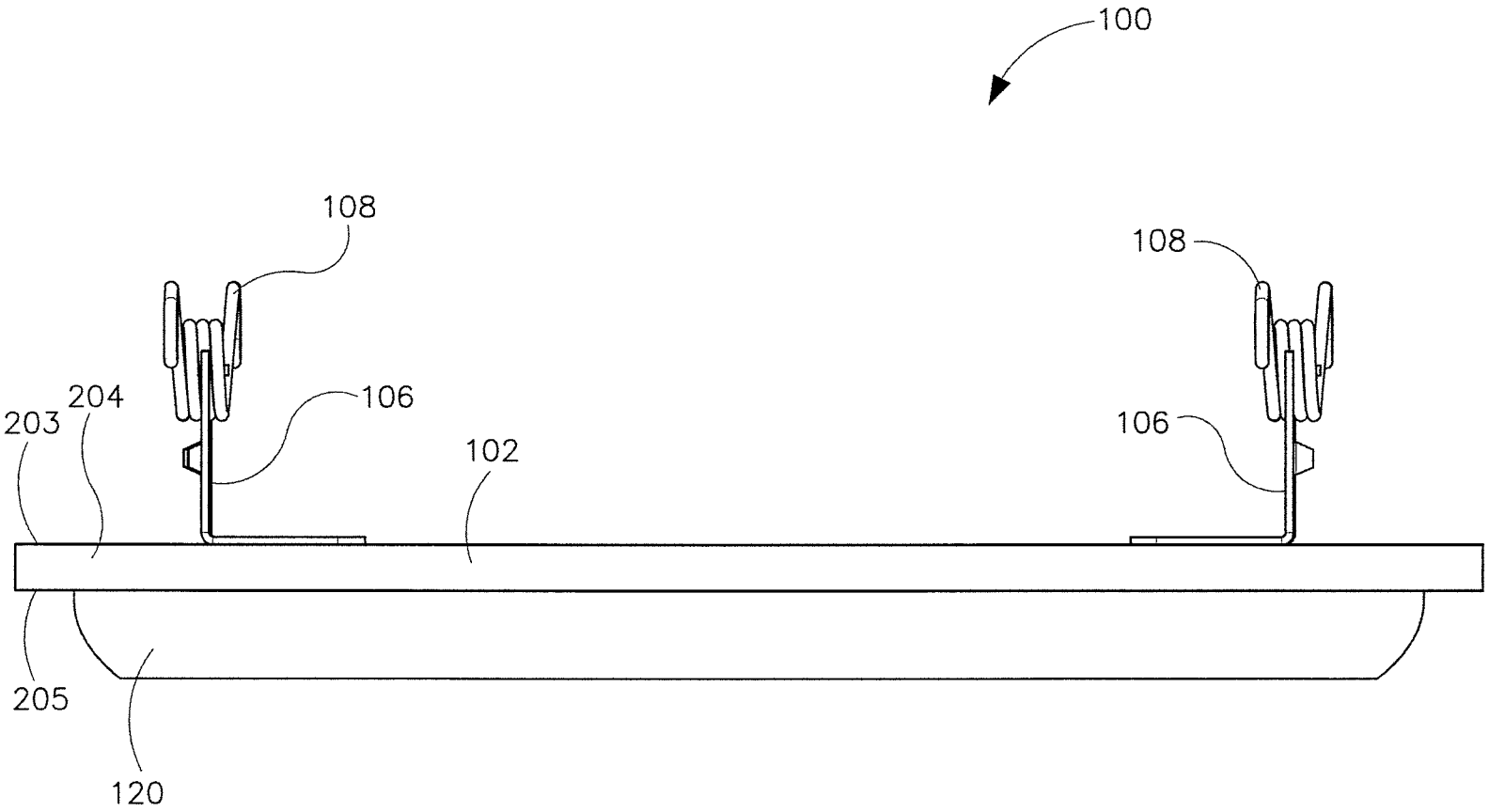
FIG. 1B illustrates a side view of the uniform lens illumination downlight fixture of FIG. 1A, in accordance with an example embodiment of the present disclosure.
Figure 1C:
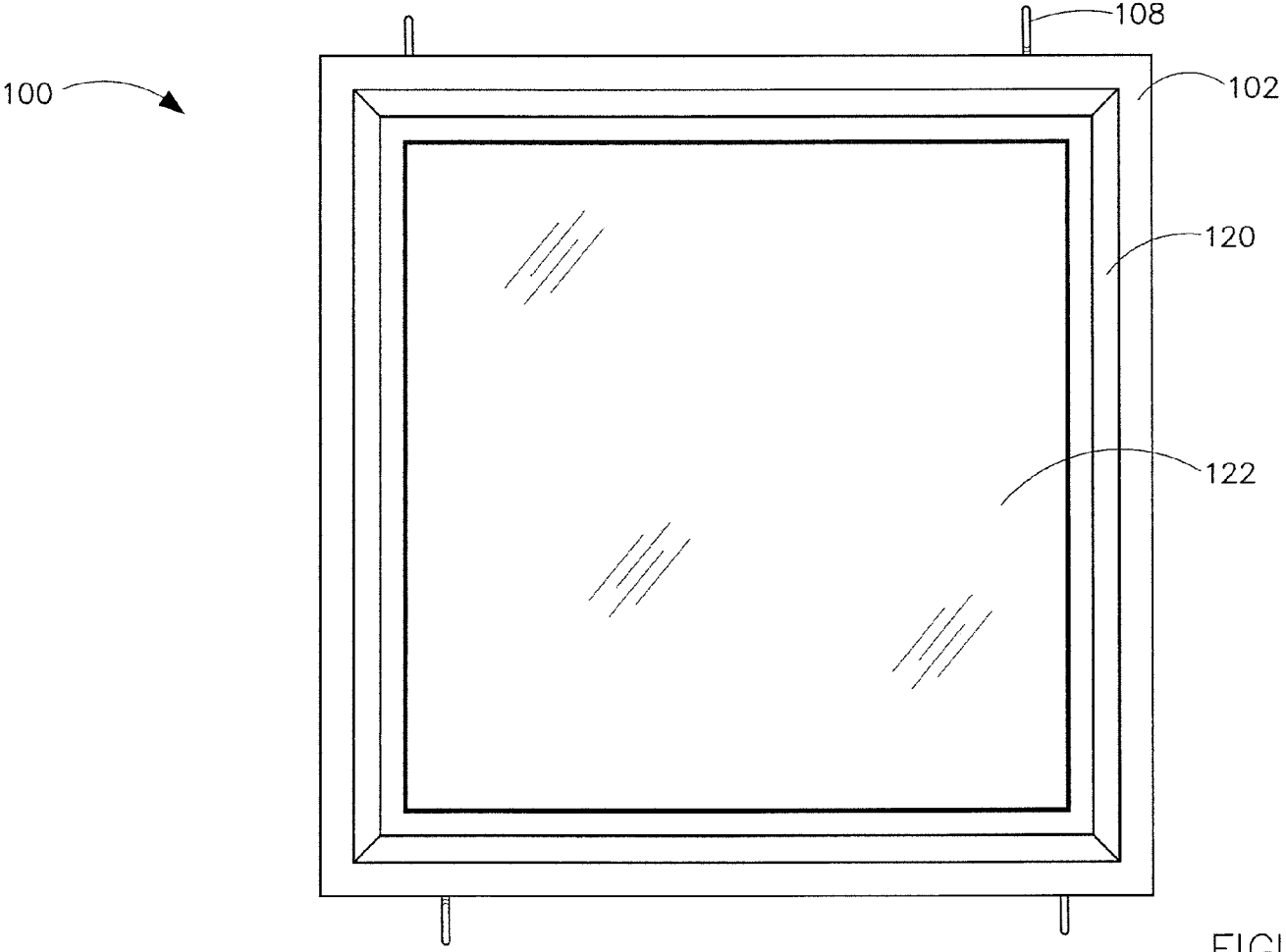
FIG. 1C illustrates a bottom view of the uniform lens illumination downlight fixture of FIG. 1A, in accordance with an example embodiment of the present disclosure.

FIGS. 1A-1C (collectively also referred to as 'FIG. 1') illustrate different views of the uniform lens illumination downlight fixture, in accordance with an example embodiment of the present disclosure. In particular, FIG. 1A illustrates a perspective view of a uniform lens illumination downlight fixture, in accordance with an example embodiment of the present disclosure; FIG. 1B illustrates a side view of the uniform lens illumination downlight fixture of FIG. 1A, in accordance with an example embodiment of the present disclosure; and FIG. 1C illustrates a bottom view of the uniform lens illumination downlight fixture of FIG. 1A, in accordance with an example embodiment of the present disclosure.

Figure 2:
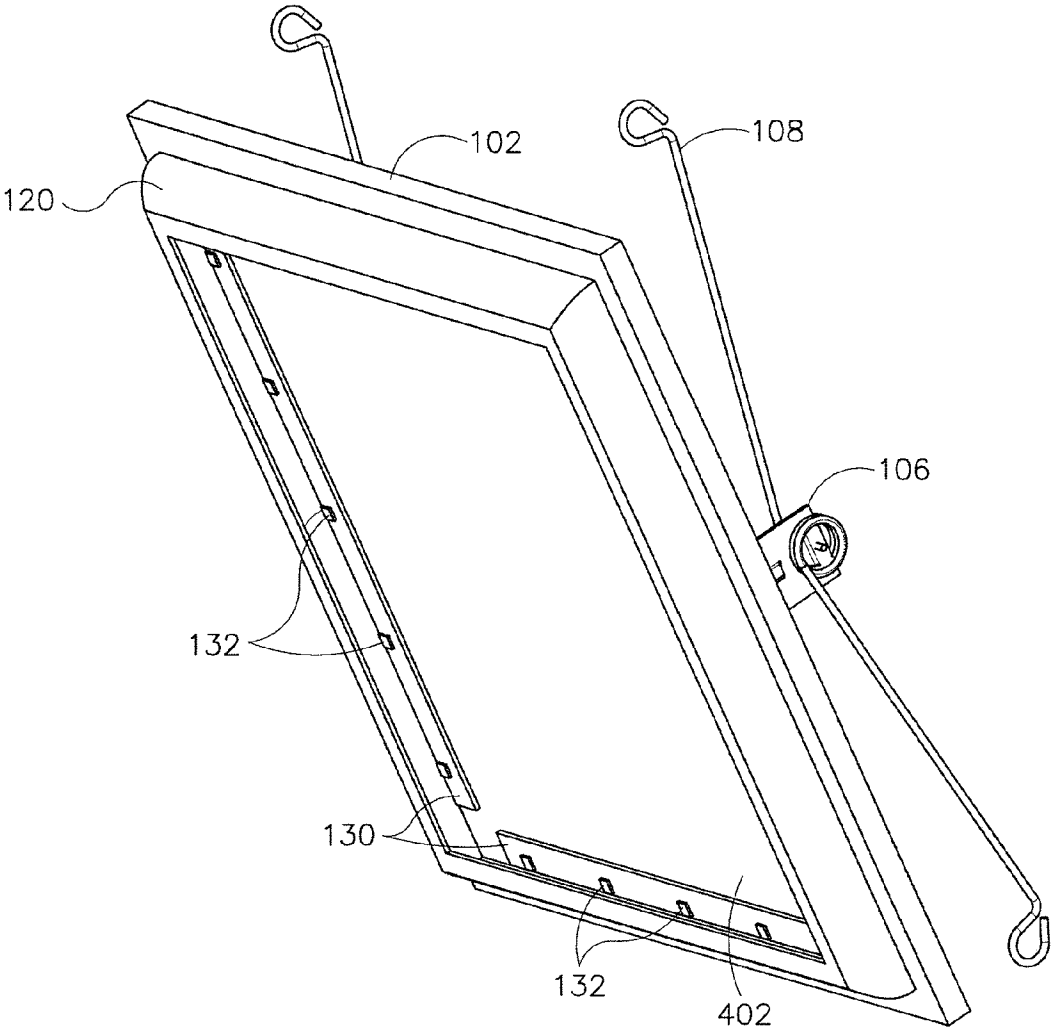
FIG. 2 illustrates a perspective view of the uniform lens illumination downlight fixture with a lens removed to illustrate an arrangement of the light sources in the downlight fixture, in accordance with an example embodiment of the present disclosure.
Figure 3:
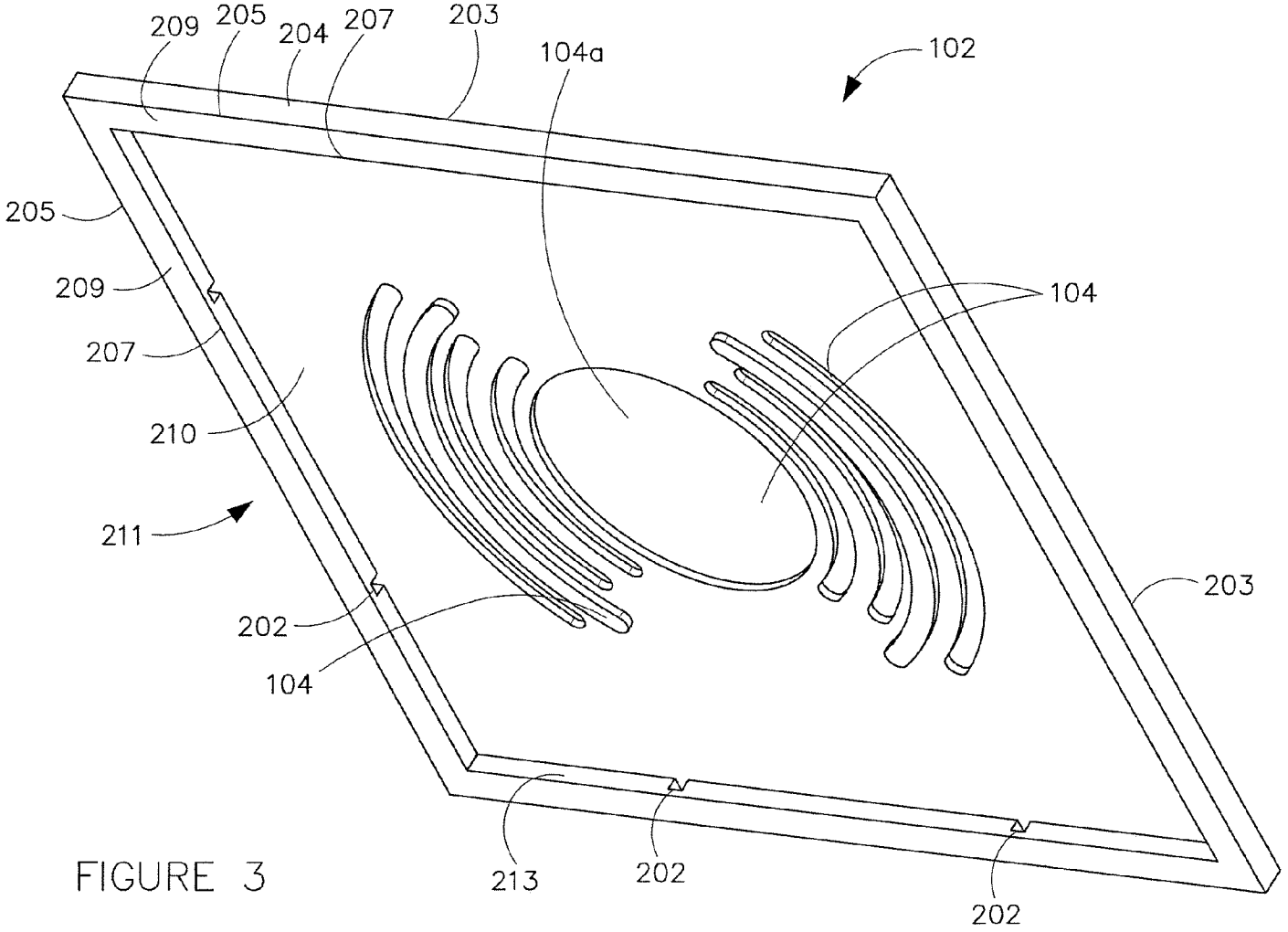
FIG. 3 illustrates a perspective view of a housing mounting plate of the uniform lens illumination downlight fixture, in accordance with an example embodiment of the present disclosure.
Figure 4:
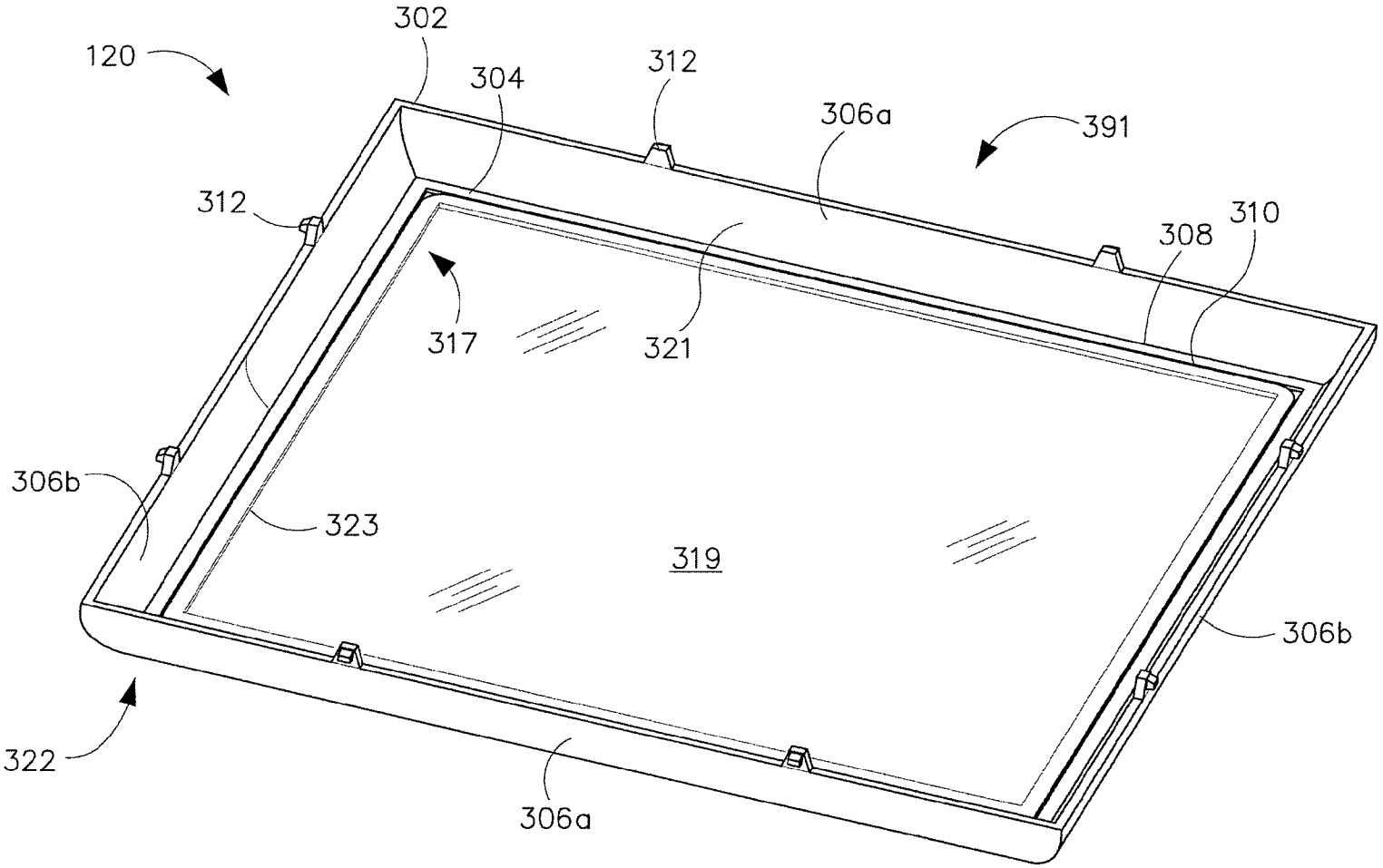
FIG. 4 illustrates a perspective view of a housing reflector plate of the uniform lens illumination downlight fixture, in accordance with an example embodiment of the present disclosure.
Figure 5:
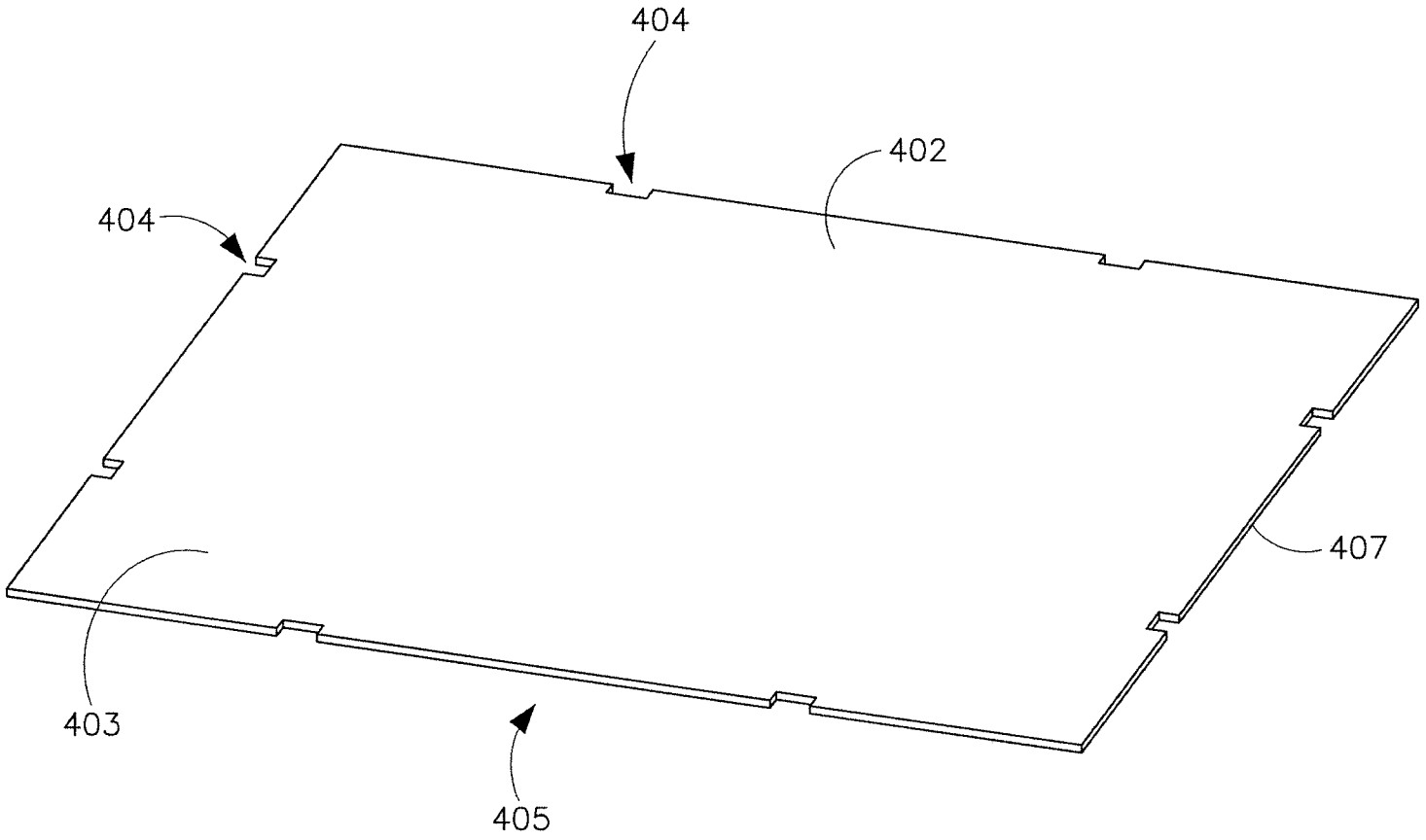
FIG. 5 illustrates a perspective view of a top reflector panel of the uniform lens illumination downlight fixture, in accordance with an example embodiment of the present disclosure.
Figure 6:
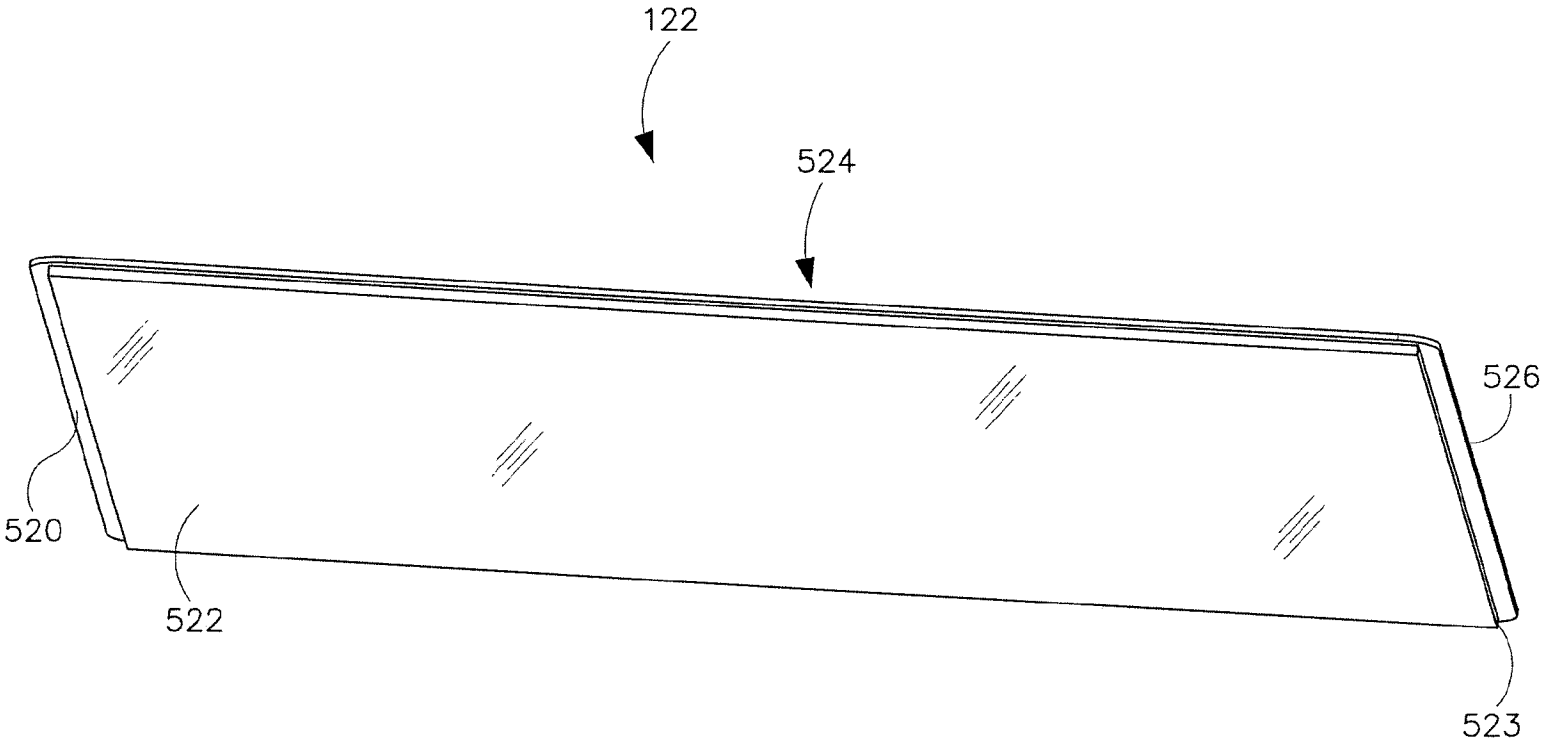
FIG. 6 illustrates a perspective view of a lens of the uniform lens illumination downlight fixture, in accordance with an example embodiment of the present disclosure.
Figure 7:
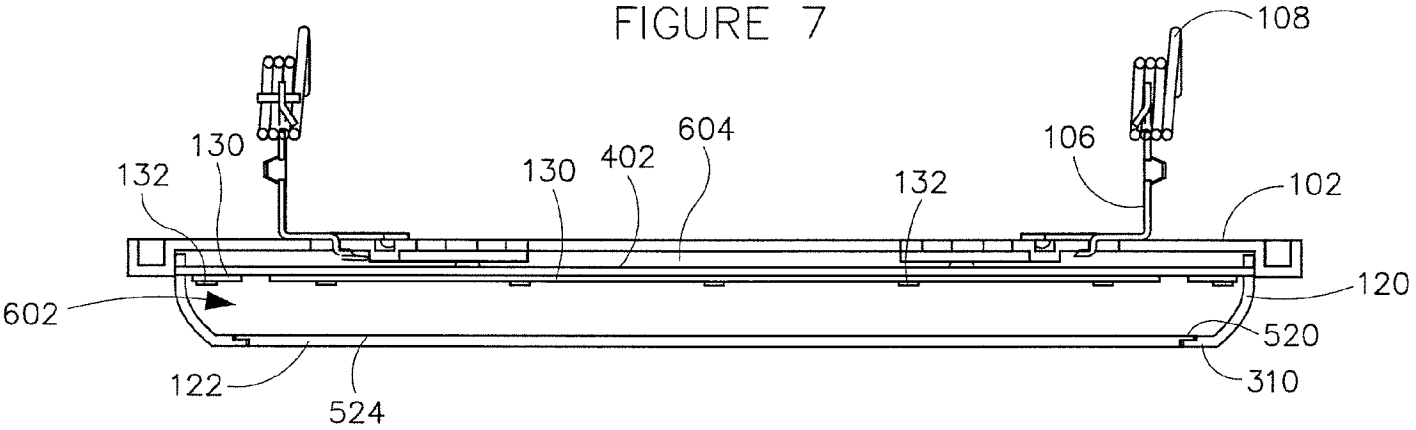
FIG. 7 illustrates a cross-sectional view of the uniform lens illumination downlight fixture of FIG. 1A along an X-X' axis, in accordance with an example embodiment of the present disclosure.
Figure 8A:
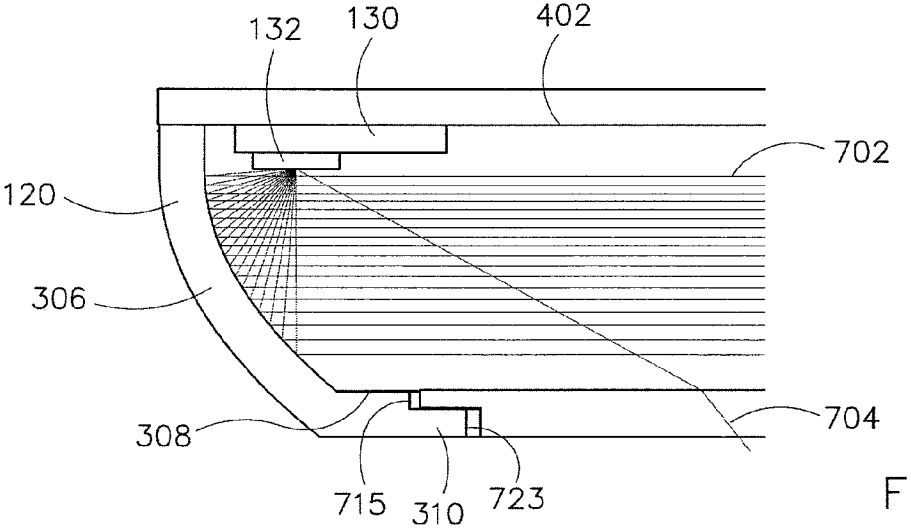
FIGS. 8A and 8B (collectively 'FIG. 8') are enlarged views of a portion of the uniform lens illumination downlight fixture illustrating light reflection and distribution in the uniform lens illumination downlight fixture, in accordance with an example embodiment of the present disclosure.
Figure 8B:
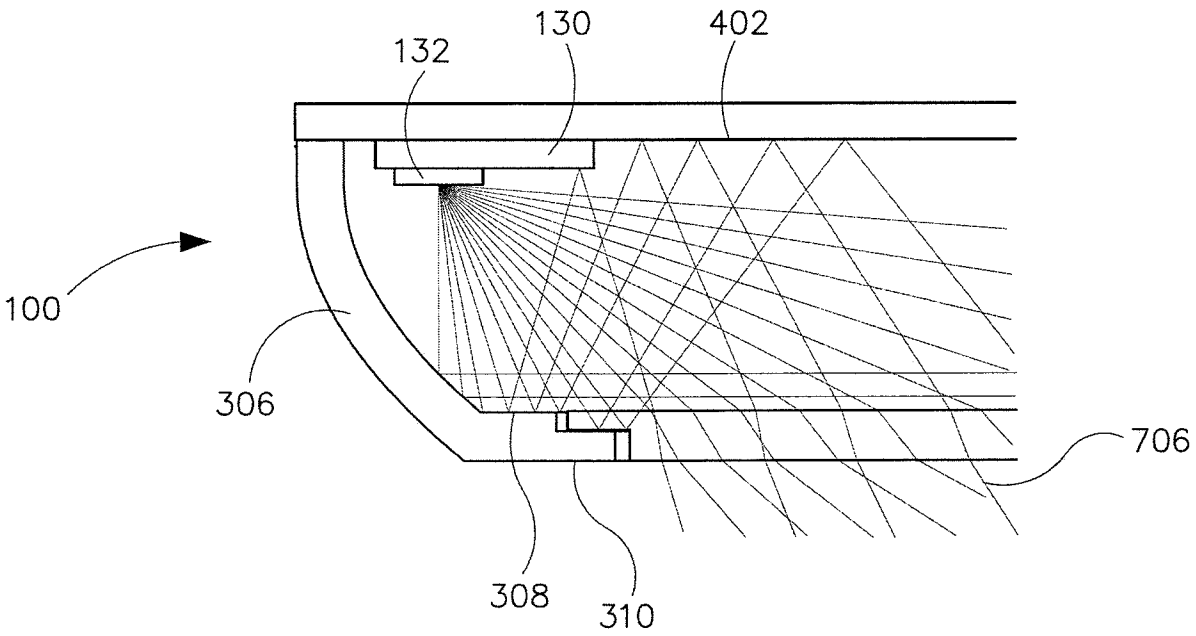

Further, FIG. 2 illustrates a perspective view of the uniform lens illumination downlight fixture with a lens removed to illustrate an arrangement of the light sources in the downlight fixture, in accordance with an example embodiment of the present disclosure; FIG. 3 illustrates a perspective view of a housing mounting plate of the uniform lens illumination downlight fixture, in accordance with an example embodiment of the present disclosure; FIG. 4 illustrates a perspective view of a housing reflector plate of the uniform lens illumination downlight fixture, in accordance with an example embodiment of the present disclosure; FIG. 5 illustrates a perspective view of a top reflector panel of the uniform lens illumination downlight fixture, in accordance with an example embodiment of the present disclosure; FIG. 6 illustrates a perspective view of a lens of the uniform lens illumination downlight fixture, in accordance with an example embodiment of the present disclosure; FIG. 7 illustrates a cross-sectional view of the uniform lens illumination downlight fixture of FIG. 1A along the X-X' axis, in accordance with an example embodiment of the present disclosure; FIGS. 8A and 8B (collectively 'FIG. 8') are enlarged views of a portion of the uniform lens illumination downlight fixture illustrating light reflection and distribution in the uniform lens illumination downlight fixture, in accordance with an example embodiment of the present disclosure; and FIG. 9 illustrates an example illumination of the lens in the uniform lens illumination downlight fixture, in accordance with an example embodiment of the present disclosure.

Referring to FIGS. 1-9, the downlight fixture 100 may include, inter alia, a housing mounting plate 102 (herein 'mounting plate 102'), a housing reflector member 120, a lens 122, a top reflector panel 402, a circuit board 130, and a plurality of light sources 132. Further, in some example embodiments, the downlight fixture 100 may optionally include a pair of torsion spring assemblies 107. Each torsion spring assembly 107 may include a torsion spring bracket 106 that is coupled to the mounting plate 102 and/or a torsion spring 108 that is coupled to the torsion spring bracket 106.

As illustrated in FIGS. 1 and 3, the mounting plate 102 of the downlight fixture 100 may include a top cover 210 that has a substantially square profile defined by the top edges 203 of the mounting plate 102. However, one of ordinary skill in the art can understand and appreciate that in other example embodiments, the top cover 210 of the mounting plate 102 can have any other appropriate geometric or non-geometric profile without departing from a broader scope of the present disclosure. In particular, the top cover 210 may include a central aperture 104*a* that has a circular profile and a plurality of elongated apertures (e.g., having a curved or linear profile) 104*b* disposed adjacent the central aperture 104*a*. The central aperture 104*a* and elongated apertures 1044*b* (collectively referred to as the "apertures 104") on the top cover 210 of the mounting plate 102 may extend through the thickness of the top cover 210 (through apertures) and may be used to attach junction boxes (J-box) of varying sizes to the downlight fixture 100, for example, when the downlight fixture 100 is surface mounted. Alternatively, the apertures 104 on the top cover 210 of the mounting plate 102 may be used to couple the torsion spring assembly 107, particularly, the torsion spring bracket 106 to the downlight fixture 100, as illustrated in FIGS. 1 and 7. The torsion spring assembly 107 may allow a user to recess mount the downlight fixture 100, for example, mounting in a ceiling similar to a recessed troffer lighting fixture.

In addition to the top cover 210, the mounting plate 102 may include a downward extending flange 211 extending along the perimeter/boundary of the top cover 210 of the mounting plate 102. In certain example embodiments, the downward extending flange 211 may have: (i) a first side wall 204 that extends substantially perpendicular to the top cover 210 from the top edge 203 to an outer bottom edge 205 of the mounting plate 102, (ii) a second side wall 209 that extends substantially parallel to the top cover 210 from the outer bottom edge 205 to an inner bottom edge 207 of the mounting plate 102, and (iii) a third side wall 213 that extends substantially perpendicular to the top cover 210 and parallel to the first side wall 204 from the inner bottom edge 207 to the top cover 210 of the mounting plate 102. As illustrated in FIGS. 1 and 3, the first side wall, the second side wall 209, and the third side wall 213 may define a thickness of the downward extending flange 211.

Further, the mounting plate 102 may include a plurality of blind apertures 202 located on the downward facing flange 211. In particular, each blind aperture 202 may extend from a portion of the third side wall 213 (adjacent the top cover 210) towards the first side wall 204. Alternatively, in other example embodiments, the apertures 202 may be through apertures. In certain example embodiments, the plurality of blind apertures 202 may be configured to attach a housing reflector member 120 of the downlight fixture 100 to the mounting plate 102 as will be described below in greater detail in association with FIGS. 4 and 7.

Referring to FIGS. 1 and 4, the housing reflector member 120 of the downlight fixture 100 may include two longitudinal curved or substantially parabolic shaped portions 306*a* (herein 'longitudinal curved portions 306*a*') and two latitudinal curved or substantially parabolic shaped portions 306*b* (herein 'latitudinal curved portions 306*b*'). Further, each curved portion (306*a*, 306*b*) may include an inner surface 321 and an outer surface 322 opposite the inner surface 321. Furthermore, each curved portion (306*a*, 306*b*) may extend from a top edge 302 of the housing reflector member 120 to an intermediate edge 304. In particular, each curved portion (306*a*, 306*b*) has a substantially concave inner profile and a substantially convex outer profile.

In certain example embodiments, as illustrated in FIG. 4, the two longitudinal curved portions 306*a* and the two latitudinal curved portions 306*b* may be coupled to each other and are arranged such that the top edges 302 of the curved portions (306*a*, 306*b*) may define a first substantially square shaped aperture 391 that is configured to be covered by the top reflector panel 402 of the downlight fixture as will be described below in greater detail in association with FIG. 5. In other example embodiments, the curved portions (306*a*, 306*b*) may be arranged such that the top edges 302 may define a first aperture having any other appropriate geometric or non-geometric shape without departing from a broader scope of the present disclosure.

In addition to the curved portions (306*a*, 306*b*), the housing reflector member 120 may include a stairway shaped portion 317 that extends substantially horizontally/laterally and inward (direction of the inner surface 321) from the intermediate edge 304 of each curved portion (306*a*, 306*b*), as illustrated in FIG. 4. In other words, the curved portion 306 and the stairway shaped portion 317 of the housing reflector member 120 may be arranged such that the stairway shaped portion 317 may be substantially parallel to the top cover 210 of the mounting plate 102 while the curved portion 306 may be at an angle (acute (internal angle) or obtuse (external angle)) to the top cover 210 of the mounting plate 102, when the housing reflector member 120 is coupled to the mounting plate 102.

In particular, the stairway shaped portion 317 may include a first planar seat portion 308, a side wall 715 (shown in FIG. 8A) that extends substantially perpendicular to and downwards from an end of the first planar seat portion 308, a second planar seat portion 310 that is substantially parallel to the first seat portion 308 and extends substantially perpendicular to and laterally from an end of the side wall 715, and a bottom edge 323 extending perpendicular to and downwards from an end of the second planar seat portion 310. In other words, the second planar seat portion 310 may be positioned adjacent to and below the first planar seat portion 308 such that they form the shape of a stairway.

Further, the stairway shaped portions 317 that extend laterally inward from the intermediate edge 304 of each curved portion (306*a*, 306*b*) may be arranged such that the bottom edges 323 of stairway shaped portions 317 may define a second substantially square shaped aperture 319 that is configured to receive a lens 122 as will be described in greater detail below in association with FIGS. 6 and 7. In other words, the top edges 302 of the housing reflector member 120 define a first substantially square shaped aperture 391 and the bottom edges 323 of the housing reflector member 120 define a second substantially square shaped aperture 319 positioned at a distance below the first substantially square shaped aperture. Further, the first substantially square shaped aperture 391 may be larger in size (or circumference) compared to the second substantially square shaped aperture 319.

As illustrated in FIG. 4, the housing reflector member 120 may further include one or more tabs 312 that extend away from the top edge 302 of the housing reflector member 120 in a direction opposite to the stairway shaped portion 317.

The one or more tabs 312 may be positioned such that they align with a position of the respective blind apertures 202 of the mounting plate 120. In particular, the one or more tabs 312 may be configured to engage and mate with the respective one or more blind apertures 202 of the mounting plate 102 to couple the housing reflector member 120 to the mounting plate 102. As illustrated in FIG. 4, in certain example embodiments, the tabs may be hook shaped or substantially L-shaped, however, in other example embodiments, the tabs 312 can have any other appropriate shape without departing from a broader scope of the present disclosure.

According to certain example embodiments, the housing reflector member 120 may be fabricated using a reflective material, such as aluminum or highly reflective white plastic; or may be fabricated using a non-reflective material and subsequently made to be reflective. For example, an inner profile of the housing reflector member 120, i.e., the inner surface 321 of the curved portion 306 and an inner surface of the stairway shaped portion 317 (facing the mounting plate 102 and/or the light sources 132), may be polished or may be painted to be made reflective so that light emitted from the plurality of the light sources 132 and directed towards the inner profile of the housing reflector member 120 may be reflected to a desired area, such as the lens 122, the luminous cavity above the lens 122, and/or the top reflector panel 402, as will be described below in greater detail in association with FIG. 8.

Even though the present disclosure describes the apertures defined by the top edges and the bottom edges of the housing reflector member as being substantially square shaped, one of ordinary skill in the art can understand and appreciate that in other example embodiments, the housing reflector member may be configured to define apertures having any other appropriate geometric or non-geometric shape without departing from a broader scope of the present disclosure. Further, the first aperture 391 may have a different shape from that of the second aperture 319. Furthermore, even though the present disclosure describes the housing reflector member as having a curved portion and a stairway shaped portion, one of ordinary skill in the art can understand and appreciate that in other example embodiments, the housing reflector member may have any other shape that allows majority of the light from the light sources to be reflected without departing from a broader scope of the present disclosure. In some embodiments, the housing reflector member may have fewer or lesser portions than that described herein without departing from a broader scope of the present disclosure. For example, in some embodiments, the housing reflector member 120 may not include the stairway shaped portion 317.

Furthermore, even though the present disclosure describes each top edge of the housing reflector member as having one or more tabs, one of ordinary skill in the art can understand and appreciate that in other example embodiments, not all the top edges may have tabs. For example, only two of the opposite top edges 302 may have the tabs 312. Additionally, even though the present disclosure describes coupling the housing reflector member to the mounting plate using the one or more tabs, one of ordinary skill in the art can understand and appreciate that in other example embodiments, any other appropriate coupling mechanism may be used without departing from a broader scope of the present disclosure. For example, the housing reflector member 120 may be coupled to the mounting plate 102 using fasteners, such as screws, rivets, clamps, etc. In another example, the housing reflector member 120 and the mounting plate 102 may be formed together as a single piece, that is, they may be integral.

Even though the present disclosure describes the housing reflector member 120 as having a curved portion and a stairway shaped portion, one of ordinary skill in the art can understand that the housing reflector member 120 is a single component where the curved portion and a stairway shaped portion are integral to the housing reflector member 120. That is, the housing reflector member 120 may include the top edge 302 that defines the first aperture 391, the bottom edge 323 that defines the second aperture 319, and a body (306, 321) that extends from the top edge 302 to the bottom edge 323. The body may include an inner surface and an outer surface, where the inner surface is made reflective. Further, the body may include a curved or sloped portion 306 that extends from the top edge 302 to the intermediate edge 304, and a stairway shaped portion 321 that extends from the intermediate edge 304 to the bottom edge 323.

Referring to FIG. 6, the downlight fixture 100 may include a lens 122. In particular, the lens 122 may include a bottom surface 522 and a top surface 524. Further, the lens 122 may include a ledge portion 520 that extends along the perimeter of the lens 122. The ledge portion 520 extends from the top surface 524 towards, but not all the way to, the bottom surface 522 of the lens 122. In certain example embodiments, the lens 122 may be a diffuser lens that diffuses, spreads out, or scatters light in some manner, to give soft light. However, in another example embodiment, instead of or in addition to the diffuser characteristic, the lens 122 may have reflective characteristics. That is, the lens 122 may be configured to reflect at least a portion of received light while allowing a remaining portion of light to pass through based on an angle of incidence of light on the lens surface (524 or 522).

In certain example embodiments, the lens 122 may be fabricated from an acrylic material and may be substantially clear or translucent. Alternatively, the lens 122 may be formed using other suitable materials, such as glass, and can be, or made to be, opaque, if desired.

As described above, in certain example embodiments, the lens 122 may be coupled to the housing reflector member 120 such that at least a portion of the lens 122 fits within and covers the second substantially square shaped aperture 319 defined by the bottom edges 323 of the housing reflector member 120, as illustrated in FIG. 7. In particular, the ledge portion 520 of the lens 122 may rest on the second planar seat portion 310 of the housing reflector member 120 such that the top surface 524 of the lens 122 is substantially flush with the first planar seat portion 308 of the housing reflector member 120. Further, a remaining portion of the lens 122, i.e., the portion of the lens apart from the ledge portion 520 fits within and covers the second substantially square shaped aperture 319 of the housing reflector member 120, as illustrated in FIG. 7. In other words, the second planar seat portion 310 of the housing reflector member 310, securely holds the lens 122 in position by engaging the ledge portion 520 of the lens 122 such that a remainder portion of the lens 122 occupies and covers the aperture 319 formed by the housing reflector member 120. Furthermore, as illustrated in FIG. 8, when the lens 122 is coupled to the housing reflector member 120, an edge 526 of the ledge portion 520 may engage and/or be in contact with the side wall 715 of the housing reflector member 120 and another edge 523 adjacent the bottom surface 522 of the lens 122 may engage and/or be in contact with the bottom edge 323 of the housing reflector member 120.

Even though the present disclosure describes a specific mechanism of coupling the lens to the housing reflector member, one of ordinary skill in the art can understand appreciate that in other example embodiments, the lens may be coupled to the housing reflector member or any other portion of the downlight fixture using any other appropriate mechanism without departing from a broader scope of the present disclosure. For example, the lens 122 may be coupled to the housing reflector member 120 using fasteners, clamps, etc.

Referring to FIG. 5, the downlight fixture 100 may further include a top reflector panel 402. In particular, the top reflector panel 402 may include a first surface 403 and a second surface 405 that is opposite to the first surface 403. The first and second surfaces (403, 405) may be confined within the edges 407 of the top reflector panel 402. Further, each edge 407 of the top reflector panel 402 may include one or more notches 404, where the position of the notches 404 may be substantially aligned with the position of the one or more tabs 312 of the housing reflector member 120.

In certain example embodiments, the top reflector panel 402 may be coupled to or positioned on top of the housing reflector member 120 such that: (a) the second surface 405 of the top reflector panel 402 rests on the top edge 302 of the housing reflector member 120 along the perimeter of the top reflector panel 402 and covering the first substantially square shaped aperture defined by the top edges 302 of the housing reflector member 120, and (b) the notches 404 of the top reflector panel 402 align with, receive, and accommodate the respective one or more tabs 312 of the housing reflector member 120.

In particular, as illustrated in FIG. 7, the top reflector panel 402 may be disposed between the housing reflector member 120 and the top cover 210 of the mounting plate 102 such that the top reflector panel 402 divides a cavity between the mounting plate 102 disposed on a top portion of the housing reflector member 120 and the lens disposed on the bottom portion of the housing reflector panel 120 into a wiring/mounting cavity 604 and a luminous cavity 602. In other words, the wiring/mounting cavity 604 may be positioned above the top reflector panel 402 and may be defined by at least the first surface 403 of the top reflector panel 402 and the top cover 210 of the mounting plate 102, while the luminous cavity 602 may be positioned below the top reflector panel 402 and may be defined by the second surface 405 of the top reflector panel 402, the inner profile of the housing reflector member 120, and the lens 122.

In certain example embodiments, the top reflector panel 402 may be fabricated using a reflective material, such as aluminum or highly reflective white plastic; or may be fabricated using a non-reflective material and subsequently made to be reflective. For example, the second surface 405 of the top reflector panel 402 facing the lens 122 may be polished or may be painted to be made reflective in order to reflect light back towards the lens 122.

Referring to FIG. 2, the downlight fixture 100 may further include one or more circuit boards 130 that are coupled to the top reflector panel 402. In particular, each circuit board 130 may be coupled to the top reflector panel 402 using any appropriate coupling mechanism, such as fasteners, adhesives, etc. Further, in certain example embodiments, each circuit board 130 may be made reflective or may be fabricated using reflective material. For example, the circuit board 130 may be a metal core printed circuit board ("MCPCB") that is made of aluminum and has a white or substantially white surface that reflects light. In alternative example embodiment, the circuit board 130 may have a green or other non-white color surface and includes a silk-screened layer of white or other highly reflective material (for example, silver) that is affixed or adhered to surface of the circuit board 130 facing the lens 122 to increase the amount of light reflected off of the circuit board 130 towards the lens 122.

Furthermore, as illustrated in FIG. 2, each circuit board 130 may include a plurality of light sources, e.g., light emitting diodes (LEDs) 132 disposed thereon. In particular, the one or more circuit boards 130 and their respective plurality of LEDs 132 may be disposed on the second surface 405 of the top reflector panel 402 adjacent a perimeter of the top reflector panel 402 such that the plurality of LEDs 132 are positioned outside a perimeter of the lens 122. For example, the plurality of LEDs 132 may be disposed on the circuit board 130 adjacent an end of the circuit board 130 that is closer to the curved portion 306 and/or the top edge 302 of the housing reflector member 120. That is, as illustrated in FIGS. 2, 7, and 8, the one or more circuit boards 130 and their respective plurality of LEDs 132 disposed thereon are positioned directly above the curved portion 306 and/or the stairway shaped portion 317 of the housing reflector member 120 such that they are at least partially hidden, by the housing reflector member 120, from the view of a person standing below and looking up at the fixture.

Further, the circuit board 130 and the LEDs 132 disposed thereon are positioned on the top reflector panel 402 such that the inner profile of the housing reflector member 120, i.e., the inner surface 321 of the curved portion 306 and an inner surface of the stairway shaped portion 317, reflects a majority of the light emitted by the LEDs 132 and reduces the amount of direct light directed towards the lens 122. For example, the LEDs 132 are positioned on the top reflector panel 402 within the downlight fixture 100 such that light emitted by the LEDs within a certain range of vertical angles (angle from a vertical axis that is normal to the LED) is reflected by the inner profile, and light emitted outside the said range of vertical angles may be emitted as direct light from the downlight fixture. In said example, light emitted by an example LED may increase in luminous intensity up to 60 degrees from a vertical/normal axis to the LED and then the luminous intensity may drop substantially beyond 60 degrees, i.e., from 60 to 90 degrees. Accordingly, the LEDs may be positioned on the top reflector panel 402 such that light emitted within the 60 degree vertical angle range (on either side) may be reflected by the inner profile of the housing reflector member 120 and light emitted outside of the 60 degree vertical angle may be directed towards the lens 122 to exit the lens 122 as direct light. Since the direct light exiting the lens 122 is light that is outside the 60 degree vertical angle, the intensity of direct light may be lower, thereby, mitigating the visual hot spot effect. Another way to ensure that most of the light having higher luminous intensity is captured and reflected by the inner profile of the housing reflector member 120 is to: (a) vary the curvature of the curved portion 306 of the housing reflector member 120 and/or (b) reduce the distance between the top reflector panel 402 and the lens 122, thereby, making the profile of the downlight fixture 100 thinner.

One of ordinary skill in the art can understand and appreciate that the above-mentioned LED example is provided only for explanatory purposes and is not limiting. That is, the downlight fixture 100 described herein may use LEDs having any other appropriate light distribution characteristics or patterns without departing from a broader scope of the present disclosure. Furthermore, even though the present disclosure describes the light source as being an LED, one of ordinary skill in the art can understand and appreciate that in other embodiments, any other appropriate point or non-point light source may be used without departing from a broader scope of the present disclosure. For example, the light source may be fluorescent tube light, bulb, etc.

In particular, the plurality of light sources 132 of the downlight fixture 100 may be powered by running electrical wires from an external power source to the plurality of light sources 132 of the downlight fixture 100 through the wiring/mounting cavity 604 of the downlight fixture 100. Alternatively, the downlight fixture 100 may be configured to hold a backup/independent power source, such as a battery, that may be used to power the plurality of light sources 132.

Referring to the example embodiment shown in FIG. 8, when operational, a first portion of the light 702 emitted by each LED 132 may be reflected by the inner surface 321 of the housing reflector member 120 (e.g., curved portion) towards the lens 122 of the downlight fixture 100 and/or the luminous cavity 602 located above the lens 122, as illustrated in FIG. 8A. Further, a second portion of the light emitted by each LED 132 may be reflected by the inner profile of the housing reflector member 120 (e.g., the curved portion 306 and/or the stairway shaped portion 317) towards the top reflector panel 402 and/or the circuit board 130 which in turn reflects the light back towards the lens 122. Some of the light that is reflected back towards the lens 122 by the top reflector panel 402 and/or the inner profile of the housing reflector member 120 may exit the lens 122 as a secondary/indirect light 706, as illustrated in FIG. 8B, while some of the light reflected towards the lens 122 may be reflected back towards the top reflector panel 402 based on an angle of incidence of the reflected light on lens 122. Alternatively, all of the light that is reflected back towards the lens 122 may exit the lens 122 without being reflected back to the top reflector panel 402. Furthermore, a third portion of the light emitted by each LED 132 may be directed towards the lens 122 without being reflected and may exit the lens 122 as a direct light 704 to an area to be illuminated.

In one example embodiment, the secondary/indirect light 706 may have a lower intensity than the direct light 704 that is output through lens 122. The lower intensity secondary/indirect light 706 may serve to reduce the contrast between the light emitted by the LEDs 132 and the areas of the downlight fixture 100 surrounding the LEDs 132 thereby providing an appearance of uniform illumination of the lens 122. Furthermore, the second portion of light 706 that is reflected into the luminous cavity 602 and/or bounces back and forth in the luminous cavity 602 may interact with the first portion of the light 702 that is reflected into the luminous cavity 602 and/or the direct light 704 to produce good color mixing before exiting through the lens 122. Further, as discussed above, the lens 122 may be a diffuse lens that is capable of scattering light, such as between the top and bottom surfaces (522, 524) of the lens 122 to cause the lens 122 to be uniformly illuminated 122.

Figure 9A:
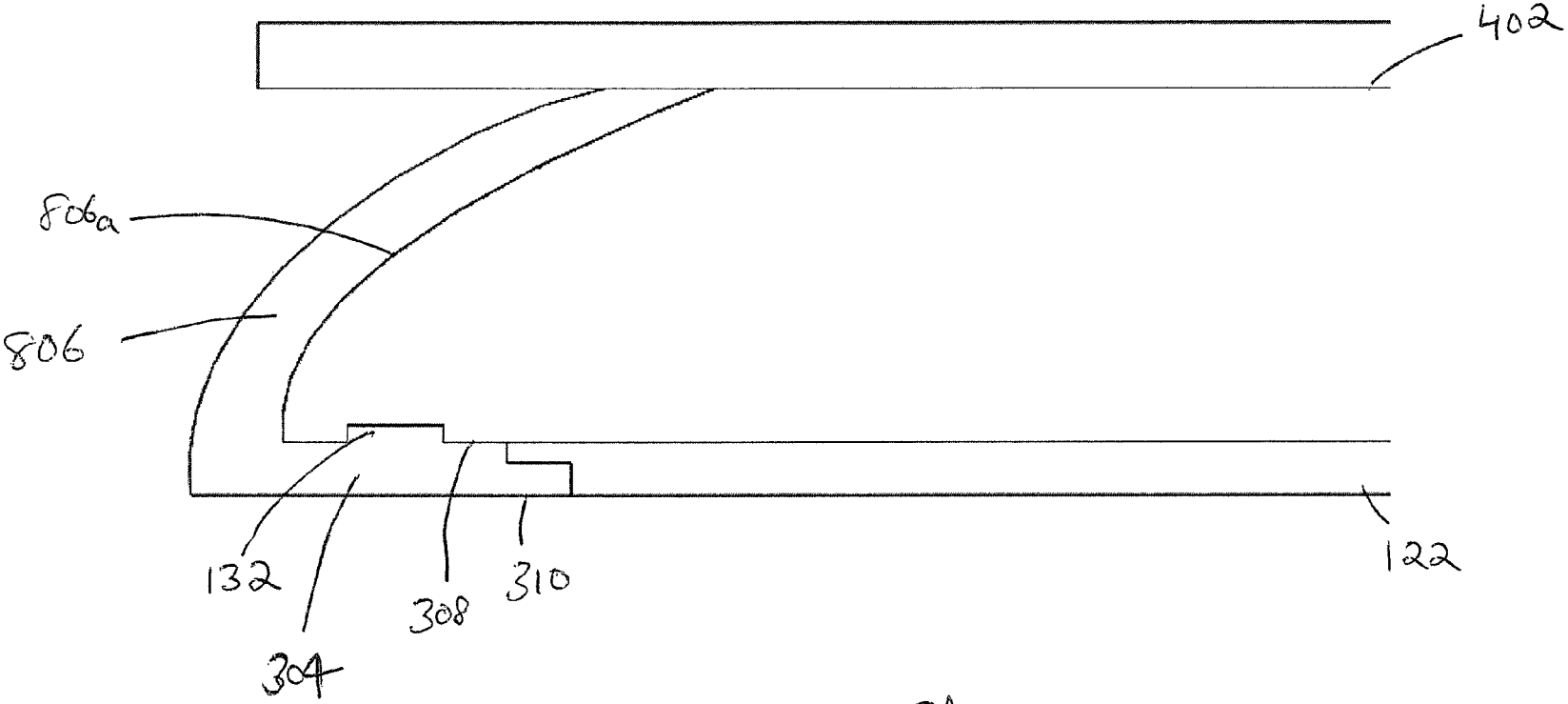
FIGS. 9A and 9B (collectively 'FIG. 9') are enlarged views of a portion of another example uniform lens illumination downlight fixture illustrating light reflection and distribution in the another example uniform lens illumination downlight fixture, in accordance with an example embodiment of the present disclosure.
Figure 9B:
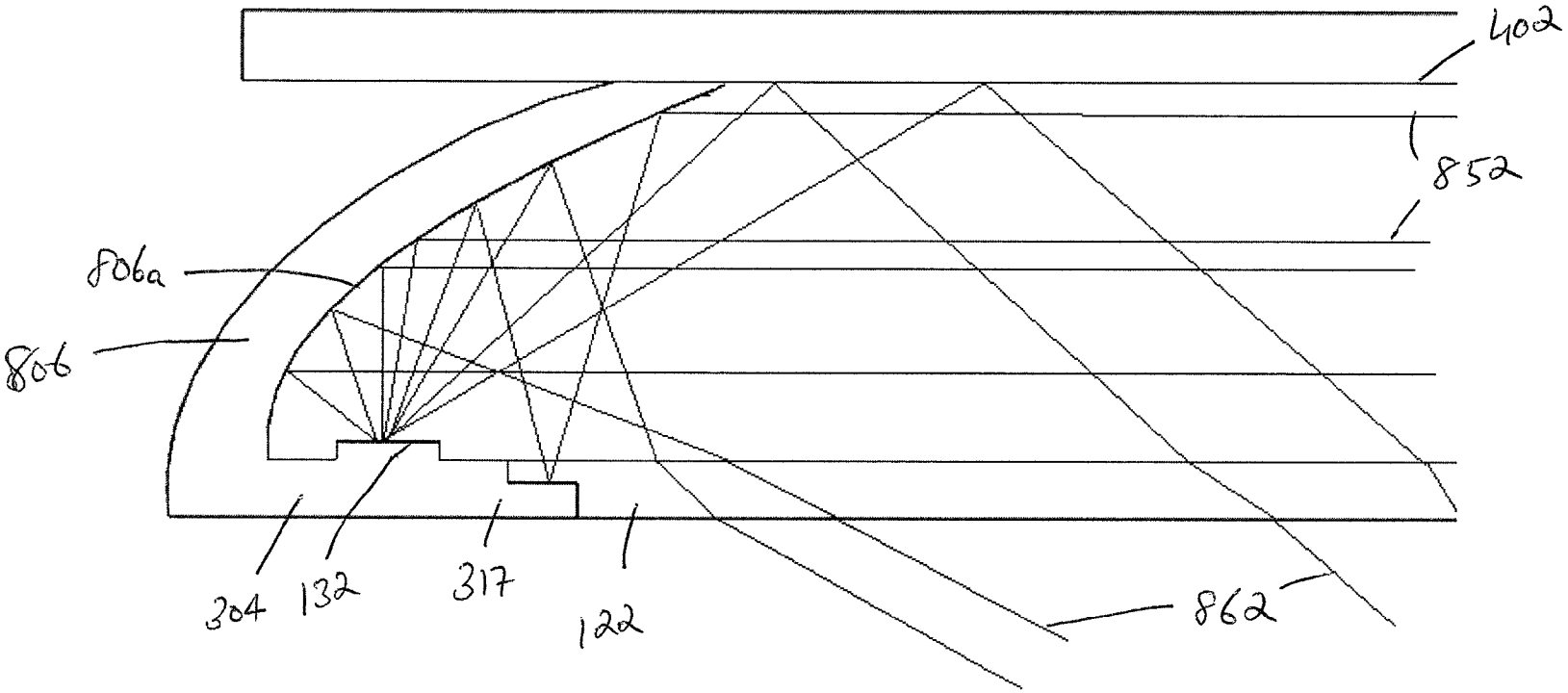

In another example embodiment, as illustrated in FIGS. 9A and 9B, the uniform lens illumination downlight fixture 900 (herein 'downlight fixture 900') may have a housing reflector member with a curved portion 806 that is configured to further reduce and/or eliminate the direct light 704 exiting the downlight fixture 900. In particular, the curved portion 806 of the housing reflector member illustrated in FIGS. 9A and 9B may be different from the curved portion 306 of the housing reflector member illustrated in FIG. 4 in that, the curved portion 806 of FIGS. 9A and 9B extends inwards from the intermediate edge 304 towards the top reflector panel 402. Further, in FIGS. 9A and 9B, the plurality of LEDs 132 may be disposed/attached to the intermediate edge 304 that is outside the perimeter of the lens 122 and below the curved portion 806 such that the plurality of LEDs 132 face an inner surface 806*a* of the curved surface 806 in an upward direction. Said arrangement of the plurality of LEDs 132 and the curved surface 806 as illustrated of FIGS. 9A and 9B, significantly reduces or eliminates any direct light from the plurality of LEDs 132 exiting the downlight fixture 900.

As illustrated in FIG. 9B, a first portion of the light 852 emitted by each LED 132 may be reflected by the inner surface 806*a* of the curved portion 806 towards the lens 122 of the downlight fixture 900, the intermediate edge 304, the stairway shaped portion 317, and/or the luminous cavity 602 located above the lens 122. Some of the light that is reflected onto the intermediate edge 304 and/or the stairway shaped portion 317 may be reflected back to the top reflector panel 402 and from there towards the lens 122 to exit the downlight fixture 900. A second portion of the light 862 emitted by each LED 132 may be reflected by the inner surface 806*a* of the curved portion 806 towards the top reflector panel 402 which in turn reflects the light back towards the lens 122. Some of the light that is reflected towards the lens 122 by the top reflector panel 402 and/or the inner surface 806*a* of the curved portion 806 may exit the lens 122 as a secondary/indirect light 862, as illustrated in FIG. 8B, while some of the light reflected towards the lens 122 may be reflected back towards the top reflector panel 402 based on an angle of incidence of the reflected light on lens 122. Alternatively, all of the light that is reflected towards the lens 122 may exit the lens 122 without being reflected back to the top reflector panel 402. In the example downlight fixture 900, none of the light emitted by the LEDs 132 may exit the lens 122 as direct light, i.e., without being reflected by the curved portion 806 and/or the top reflector panel 402. That is, almost all of the light exiting the downlight fixture 900 may be indirect light. Accordingly, the illumination of the lens 122 in the example downlight fixture 900 is more uniform than when direct light exits the lens 122.

Although the disclosures provides example embodiments, it should be appreciated by those skilled in the art that various modifications are well within the scope of the disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A downlight fixture comprising:

a mounting plate configured to mount the downlight fixture to a mounting surface;

a housing reflector member coupled to and disposed below the mounting plate, the housing reflector member comprising:

a top edge that defines a first aperture;

a bottom edge that defines a second aperture disposed below and opposite the first aperture; and a reflector body extending between the top edge and the bottom edge and having an inner surface and an outer surface that is opposite to the inner surface;

a top reflector panel coupled to the housing reflector member such that at least a portion of the top reflector panel covers the first aperture;

a lens coupled to the housing reflector member such that at least a portion of the lens covers the second aperture; and a plurality of light sources disposed on a surface of the top reflector panel facing the lens and adjacent a perimeter of the top reflector panel such that the plurality of light sources are: (a) outside a perimeter of the lens, and (b) above the reflector body of the housing reflector member.

2. The downlight fixture of claim 1, wherein the reflector body of the housing reflector member comprises:

a curved portion having a substantially concave inner profile and extending from the top edge of the housing reflector member to an intermediate edge of the housing reflector member that is below the top edge; and a stairway shaped portion extending substantially laterally inwards from the intermediate edge of the housing reflector member to the bottom edge of the housing reflector member.

3. The downlight fixture of claim 2, wherein the stairway shaped portion comprises a first seat portion that is substantially planar shaped and a second seat portion disposed below and adjacent the first seat portion such that the first seat portion and the second seat portion form a shape of a stairway, and wherein the second seat portion is substantially planar shaped.

4. The downlight fixture of claim 2, wherein the lens is coupled to the stairway shaped portion of the housing reflector member.

5. The downlight fixture of claim 1, wherein the top edge of the housing reflector member includes one or more tabs that are configured to couple the housing reflector member to the mounting plate.

6. The downlight fixture of claim 1, wherein one or more edges of the top reflector panel comprises one or more notches configured to accommodate one or more tabs on the top edge of the housing reflector member.

7. The downlight fixture of claim 1, wherein the surface of the top reflector panel facing the lens is reflective, wherein the inner surface of the housing reflector member's reflective body is reflective, and wherein the lens is a diffuser lens.

8. The downlight fixture of claim 1, further comprising one or more circuit boards disposed on the surface of the top reflector panel facing the lens and adjacent the perimeter of the top reflector panel, and wherein the plurality of light sources are disposed on the one or more circuit boards.

9. The downlight fixture of claim 1, wherein a portion of light emitted by the plurality of light sources is reflected by the inner surface of the housing reflector member's reflector body towards a luminous cavity between the lens and the top reflector panel.

10. The downlight fixture of claim 1, wherein a portion of the light emitted by the plurality of light sources is reflected by the inner surface of the housing reflector member's reflector body towards the lens to exit the lens as indirect light.

11. The downlight fixture of claim 1, wherein a portion of the light emitted by the plurality of light sources is reflected by the inner surface of the housing reflector member's reflector body towards the top reflector panel, which further reflects the light back towards the lens to exit the lens as indirect light.

12. The downlight fixture of claim 1, wherein a portion of the light emitted by the plurality of light sources is directed towards the lens to exit the lens as direct light.

13. The downlight fixture of claim 1, wherein the plurality of light sources comprise light emitting diode (LED) light sources.

14. A downlight fixture comprising:

a housing reflector member, the housing reflector member comprising:

a curved portion having a substantially concave inner profile and extending from a top edge of the housing reflector member to an intermediate edge of the housing reflector member; and a stairway shaped portion disposed below the curved portion and extending substantially laterally inwards from the intermediate edge of the housing reflector member to a bottom edge of the housing reflector member;

a top reflector panel coupled to the curved portion of the housing reflector member such that at least a portion of a perimeter of the top reflector panel is disposed on the top edge of the housing reflector member;

a lens coupled to the stairway shaped portion of the housing reflector member adjacent the bottom edge of the housing reflector member; and a plurality of light emitting diodes (LEDs) disposed on a surface of the top reflector panel facing the lens and adjacent the perimeter of the top reflector panel such that the plurality of LEDs are positioned: (a) outside a perimeter of the lens, and (b) above the curved portion of the housing reflector member.

15. The downlight fixture of claim 14, further comprising a mounting plate that is coupled to the housing reflector member such that the housing reflector member is disposed below the mounting plate and the top reflector panel is disposed substantially in between the mounting plate and the housing reflector member.

16. The downlight fixture of claim 14, further comprising one or more circuit boards disposed on the surface of the top reflector panel facing the lens and adjacent the perimeter of the top reflector panel, wherein the plurality of LEDs are disposed on the one or more circuit boards adjacent an end of each circuit board that is closer to the curved portion and/or the top edge of the housing reflector member.

17. The downlight fixture of claim 14:

wherein the mounting plate comprises a plurality of apertures configured to couple a junction box and/or a mounting bracket to the downlight fixture wherein the surface of the top reflector panel facing the lens is reflective, wherein the inner surface of the housing reflector member's reflective body is reflective, and wherein the lens is a diffuser lens, wherein a portion of light emitted by the plurality of LEDs is reflected by the curved portion of the housing reflector member towards a space above the lens, and wherein another portion of the light emitted by the plurality of LEDs is reflected by at least one of the curved portion and the stairway shaped portion of the housing reflector member towards the lens to exit the lens as indirect light.

18. A downlight fixture comprising:

a mounting plate configured to mount the downlight fixture to a mounting surface;

a housing reflector member coupled to and disposed below the mounting plate, the housing reflector member comprising:

a top edge;

a bottom edge that defines an aperture; and a reflector body extending between the top edge and the bottom edge and having a reflective inner surface and an outer surface that is opposite to the reflective inner surface;

a top reflector panel coupled to the top edge of the housing reflector member;

a lens coupled to the housing reflector member such that at least a portion of the lens covers the aperture; and a plurality of light sources disposed on the housing reflector member adjacent the bottom edge of the housing reflector member such that the plurality of light sources are outside a perimeter of the lens.

19. The downlight fixture of claim 18, wherein the reflector body of the housing reflector member comprises:

a curved portion having a substantially concave inner profile and extending inward from an intermediate edge of the housing reflector member that is adjacent the bottom edge of the housing reflector member to the top edge of the housing reflector member; and a stairway shaped portion extending substantially laterally inwards from the intermediate edge of the housing reflector member to the bottom edge of the housing reflector member.

20. The downlight fixture of claim 19, wherein the plurality of light sources are disposed on the intermediate edge and faces the reflective inner surface of the housing reflector member.

* * * * *